US011254474B2

(12) United States Patent
Pearce

(10) Patent No.: US 11,254,474 B2
(45) Date of Patent: Feb. 22, 2022

(54) SPOUT SEAL FOR A CONTAINER

(71) Applicant: PURATAP PTY LTD, Stepney (AU)

(72) Inventor: Scott Pearce, Lonsdale (AU)

(73) Assignee: PURATAP PTY LTD

( * ) Notice: Subject to any disclaimer, the term of this patent is extended or adjusted under 35 U.S.C. 154(b) by 175 days.

(21) Appl. No.: 16/648,416

(22) PCT Filed: Sep. 14, 2018

(86) PCT No.: PCT/AU2018/051011
§ 371 (c)(1),
(2) Date: Mar. 18, 2020

(87) PCT Pub. No.: WO2019/056056
PCT Pub. Date: Mar. 28, 2019

(65) Prior Publication Data

US 2021/0362917 A1 Nov. 25, 2021

(30) Foreign Application Priority Data

Sep. 19, 2017 (AU) ..... 2017903811

(51) Int. Cl.
*B65D 47/06* (2006.01)
*B65D 47/28* (2006.01)

(52) U.S. Cl.
CPC ..... *B65D 47/063* (2013.01); *B65D 47/283* (2013.01)

(58) Field of Classification Search
CPC ..... B65D 47/063; B65D 47/283
USPC ..... 222/559
See application file for complete search history.

(56) References Cited

U.S. PATENT DOCUMENTS 3,203,665 A * 8/1965 Grant ..... B65D 47/283 251/351
7,533,783 B2 5/2009 Choi et al.
8,701,906 B1 4/2014 Anderson
2011/0198361 A1 8/2011 Chen
(Continued)

FOREIGN PATENT DOCUMENTS

CN 107074408 8/2017
FR 2895732 7/2007
FR 2895732 A1 * 7/2007 ..... B65D 47/063
(Continued)

OTHER PUBLICATIONS

Translation of FR-2895732-A1 from EPO.org.*

*Primary Examiner* — Jeremy Carroll
(74) *Attorney, Agent, or Firm* — Sand, Sebolt & Wernow Co., LPA

(57) ABSTRACT

There is proposed a seal for a retractable spout of a container, comprising a flexible generally elongate tubular body including a first annular end and an opposite second annular end. The first annular end of the seal is fixedly held circumferentially around or adjacent, an opening in the container through which the spout is configured to extend to thereby inhibit movement of a flowable substance out between an outer surface of said spout and an edge of said opening. The second annular end of the seal engaging with and extending outwardly from a lower or inner end of said spout. In this way when the spout is in a retracted position the second annular end bears against a bearing surface of the container to thereby inhibit movement of said flowable substance out through said spout.

14 Claims, 11 Drawing Sheets

(56) References Cited

U.S. PATENT DOCUMENTS

| | | | | |
|---|---|---|---|---|
| 2013/0270307 | A1* | 10/2013 | Crosby | B65D 51/20<br>222/530 |
| 2016/0318671 | A1* | 11/2016 | Sessions | B65D 25/44 |

FOREIGN PATENT DOCUMENTS

| | | | | |
|---|---|---|---|---|
| JP | H09226802 | | 9/1997 | |
| WO | 1995021776 | | 8/1995 | |
| WO | 2016044890 | | 3/2016 | |
| WO | WO-2016044890 | A1 * | 3/2016 | B65D 47/244 |
| WO | 2018176097 | | 10/2018 | |

* cited by examiner

SPOUT SEAL FOR A CONTAINER

FIELD OF THE INVENTION

The present disclosure relates to a seal for a container and in one aspect relates to a seal for a retractable spout of a drinking vessel.

BACKGROUND OF THE INVENTION

There are various types of dispensing containers currently on the market that include a sealable spout. A popular use of such dispensing containers is for drink bottles configured to hold water or other fluids.

A simply type of spout used for drinking bottles has a push-pull configuration, wherein when the spout is physically pulled into an extended arrangement a passageway is opened to allow movement of the fluid therethrough. One example of such as spout is disclosed in U.S. Pat. No. 8,701,906 to Blast Max LLC., that has a push-pull, flow-through drinking spout including upper and lower seals.

Another drink bottle is disclosed in US 20110198361 (Chen), which teaches a bottle cap with a pivotal spout that is configured to be positioned at an obtuse angle for drinking and stored vertically in a crevice, flush against one side of a loop handle when not in use. These types of bottles primarily rely upon the misaligned of channels to inhibit the flow of the fluid therethrough and often include a flexible abutment surface or button seal.

All the above types of seals however tend to wear over time, which may result in leakage of the fluid.

Other drink bottle manufactures use bite-actuated mouthpieces that allow passage of a fluid when a user bites onto the spout. One such spout is disclosed in U.S. Pat. No. 7,533,783 to Camelbak Products, LLC., that teaches a drink bottle include a bite-actuated dispensing spout that is pivotally coupled to the cap of the drink bottle.

Such bite-actuated mouthpieces however have a tendency to suffer from mechanical damage during use, which may lead to leakage or failure of the seal.

The present invention will be described with particular reference to a fluid, such as water, however the reader should appreciate that the seal could be used with respect to containers for holding any type of flowable material including, but not limited to, granular material, such as salt, spices or sugar.

It is an object of the present invention to provide a seal for a retractable spout. It is another object of the present invention to overcome at least some of the aforementioned problems or at least provide the public with a useful alternative.

It should be appreciated that any discussion of the prior art throughout the specification is included solely for the purpose of providing a context for the present invention and should in no way be considered as an admission that such prior art was widely known or formed part of the common general knowledge in the field as it existed before the priority date of the application.

SUMMARY OF THE INVENTION

In one aspect of the invention, but not necessarily the broadest or only aspect, there is proposed a seal for a retractable spout of a container, comprising:

a flexible generally elongate tubular body;

a first annular end fixedly held circumferentially around or adjacent, an opening in said container, through which said retractable spout is configured to move, to thereby inhibit movement of a flowable substance out between an outer surface of said tubular body and an edge of said opening; and an opposite second annular end fixedly couplable to and extending downwardly from a lower end of said retractable spout, whereby when the retractable spout is in a retracted position the second annular end of the seal bears against an abutment surface to thereby inhibit movement of said flowable substance out through said retractable spout, wherein an intermediate portion of the tubular body moves inwardly of the first annular end, such that it is inverted or folded over itself when the spout is moved from said retracted position into an extended position, such that the intermediate portion of the tubular body rolls or folds over itself.

In a sense the tubular body rolls or folds over itself as the spout moves into the retracted position. Alternatively, the intermediate portion may have a concertina configuration or otherwise collapse upon itself.

The intermediate portion may be of a uniform thickness or may have a plurality of annular grooves or ridges therearound.

In one form the bearing surface comprise a platform that is spaced apart from said opening.

Preferably the container includes a lid assembly having a cover with a first aperture extending therethrough and an internal frame having a second aperture extending therethrough, wherein the first and second apertures coaxially align to thereby delineate said opening in the container.

In a preferred form, the first annular end is fixedly held by the internal frame, wherein the spout is able to at least partly retract through the second aperture when in said retracted position, and extend at least partly through the first aperture when in said extended position.

The second aperture of the internal frame is dimensioned to allow passage of at least a part of the intermediate portion therethrough and may be dimensioned to allow passage of the second annular end, when the spout is being moved between the retracted and extended positions.

The internal frame may include a plurality of depending legs, preferably three legs, which hold the platform in a spaced apart position inwardly of said opening. Preferably the internal frame, depending legs and platform are unitary in construction.

In one form the first end of the seal includes an outwardly projecting circumferential shoulder, wherein a downwardly open groove extends into or is formed by the shoulder, such that the groove extends generally circumferentially around the first end. The upper surface of the shoulder may also include an inner annular lip that extends therearound. The shoulder is configured to engage with the internal frame to thereby fixedly hold the first end thereto.

In one form, the internal frame is formed by two separate members that are configured to cooperate to thereby hold or clamp the first end or shoulder of the seal therebetween. The internal frame may comprise an upper surface of a base member and an insert that may be connected to the lid base member using fixing means such as screws or may be configured to clip together or frictionally engage. The upper surface of the lid base member may include an annular shaped upstand that is configured to engage with the downwardly open groove of the seal, and the insert abuts an upper surface of the shoulder outwardly of the inner annular lip.

Preferably, the inner annular lip provides greater flexibility for the intermediate portion as it moves inwardly of the first annular end.

The second annular end may include a plurality of spaced apart thickened portions, which assist in the engagement with the inner end of the spout, such that the second annular end is inhibited from detaching therefrom.

In another form, the intermediate portion of the seal may be tapered inwardly toward the second annular end, at between 1 and 5 degrees, and preferably 2 degrees, wherein the tapered intermediate portion is configured to engage with a correspondingly shaped tapered portion of the spout to thereby assist with maintaining fractional engagement therebetween.

It may be that injection moulding of the seal profile will be easier where the seal includes a taper. Where a tapered seal is used the spout preferably has a corresponding taper so that the seal remains supported at least partially therealong. However, the reader should appreciate that the taper is not essential and furthermore a tapered seal could be used on a spout that does not include a corresponding taper.

The seal may be constructed from thermoplastic elastomers (TPE) having a polypropylene base. Other copolymers or polymer mixes with thermoplastic and elastomeric properties may also be used. Other materials that could be used include, but are not limited to, silicon rubber, EPDM rubber, silicon or any material with suitable elastomeric properties. UV stabilisers may be added to the material forming the seal to inhibit degradation due to the effects of sunlight.

Preferably the seal is unitary in construction and may be formed by injection moulding.

In another aspect of the invention there is proposed a sealable container, including, a body having a chamber for holding a flowable substance, a lid connectable to said body, the lid including an opening extending therethrough, a spout movable through said opening between a retracted position and an extended position, a platform inward of and spaced apart from said opening, and a flexible generally tubular seal surrounding a portion of the spout, the tubular seal having first and second annular ends, wherein the first annular end being fixedly held circumferentially around or adjacent said opening and the second annular end coupled to, and extending downwardly from a lower or inner end of the spout, whereby the seal inhibits movement of said flowable substance out between an outer surface of the spout and a circumferential edge of the opening, the second annular end of the seal engageable with said platform when the spout is in a retracted position to inhibit said flowable substance moving out through said spout.

In still another aspect of the invention there is proposed a method of sealing a container having a movable spout, including the steps of:

providing a container, including a body having a chamber for holding a flowable substance, a lid connectable to said body, the lid including an opening extending therethrough, a spout movable through said opening between a retracted position and an extended position, and a platform inward of and spaced apart from said opening;

providing a flexible generally tubular seal having a first annular end, an intermediate portion and a second annular end;

inserting the spout into the generally tubular seal, wherein the first annular end and intermediate portion circumferentially extend around the spout and the second annular end is coupled to and extends downwardly from a lower or inner end of the spout;

fixing the first annular end circumferentially around, or adjacent, said opening to thereby inhibit movement of the flowable substance out between an outer surface of the spout and a circumferential edge of said opening; and causing the spout, to be moved from:

a. a retracted position, wherein the second annular end bears against the platform or an insert supported thereon to thereby inhibit movement of the flowable substance through the spout;

b. through transitional positions, wherein said intermediate portion of the tubular seal is inverted or folded over itself; and c. into an extended position, whereby the second annular end is separated from the platform or insert supported thereon, wherein said flowable substance is able to flow out through the spout.

BRIEF DESCRIPTION OF THE DRAWINGS

The accompanying drawings, which are incorporated in and constitute a part of this specification, illustrate an implementation of the invention and, together with the description and claims, serve to explain the advantages and principles of the invention. In the drawings.

DETAILED DESCRIPTION OF THE ILLUSTRATED AND EXEMPLIFIED EMBODIMENTS

Figure 1:
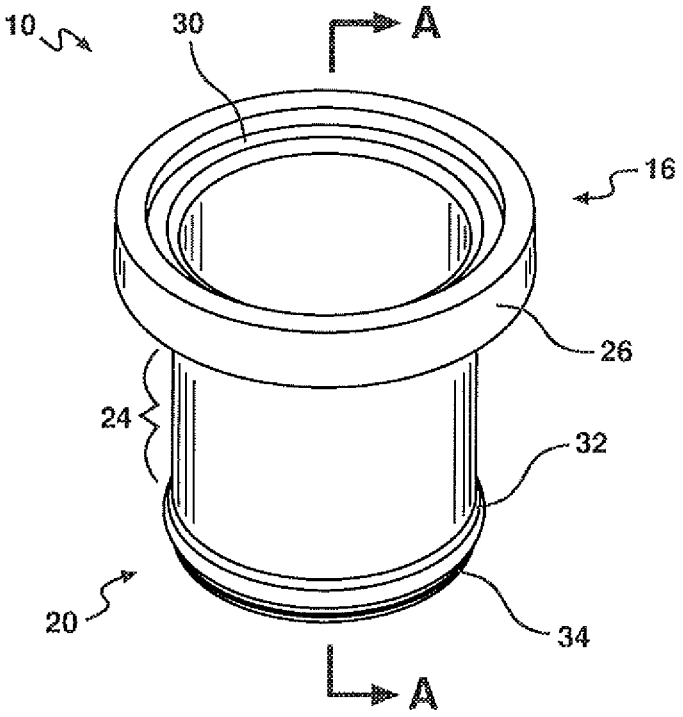
FIG. 1 is a perspective view one embodiment of the seal of the present invention.

Similar reference characters indicate corresponding parts throughout the drawings. Dimensions of certain parts shown in the drawings may have been modified and/or exaggerated for the purposes of clarity or illustration.

Referring to the drawings for a more detailed description, there is illustrated a seal 10 for a spout 12 of a container 14, demonstrating by way of examples, arrangements in which the principles of the present invention may be employed.

Figure 3A:
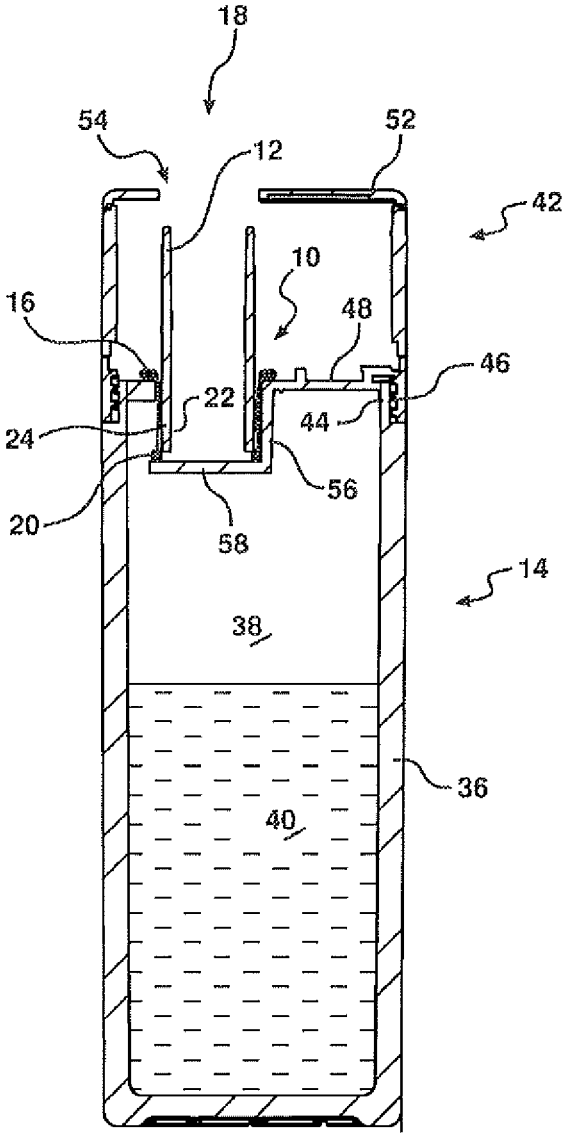
FIG. 3*a* is a schematic view of the seal located within a bottle having a movable spout, illustrating the spout in a retracted position.

As illustrated in FIG. 1 the seal 10 includes a first annular end 16 that is configured to be fixedly held circumferentially around, or adjacent, an opening 18 in the container 14. The seal 10 further includes a second annular end 20 for engagement with and configured to extend outwardly, or in the present embodiment downwardly, from an inner or lower end 22 of said spout 12, as illustrated in FIG. 3*a*. An intermediate portion 24 of the seal 10 is, in the present embodiment, generally tubular, however the reader will appreciate that it may have a concertina configuration or any other suitable configuration to permit operation of the seal 10.

Figure 2:
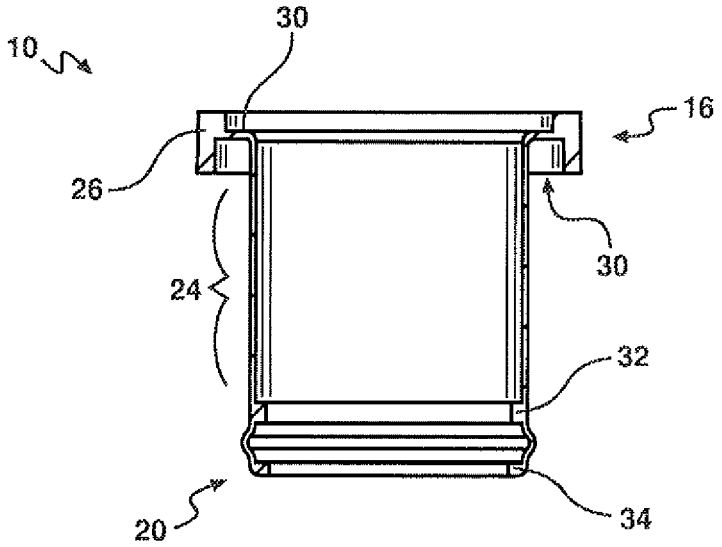
FIG. 2 is a cross-sectional view through A-A of the seal of FIG. 1.

In the present embodiment, the first annular end 16 includes an outwardly projecting circumferential shoulder 26, as illustrated in FIG. 2. The circumferential shoulder 26 includes a downwardly open groove 28 that extends thereinto or is at least formed by the shoulder 26, such that the groove 28 extends generally circumferentially around the first annular end 16. The upper surface of the shoulder 26 includes an annular lip 30 that extends therearound.

In the present embodiment, the second annular end 20 includes two spaced apart thickened portions 32, 34, which assist in the engagement with the lower end 22 of the spout 12 and inhibits the seal 10 from detaching therefrom. The thickened portions 32, 34 also assist with sealing when abutting the platform 56. The reader should however appreciate that the second annular end 20 may not include thickened portions, such that it is of uniform thickness, whereby in such a case engagement would rely primarily upon frictional engagement to inhibit detachment from the spout 12.

Figure 3B:
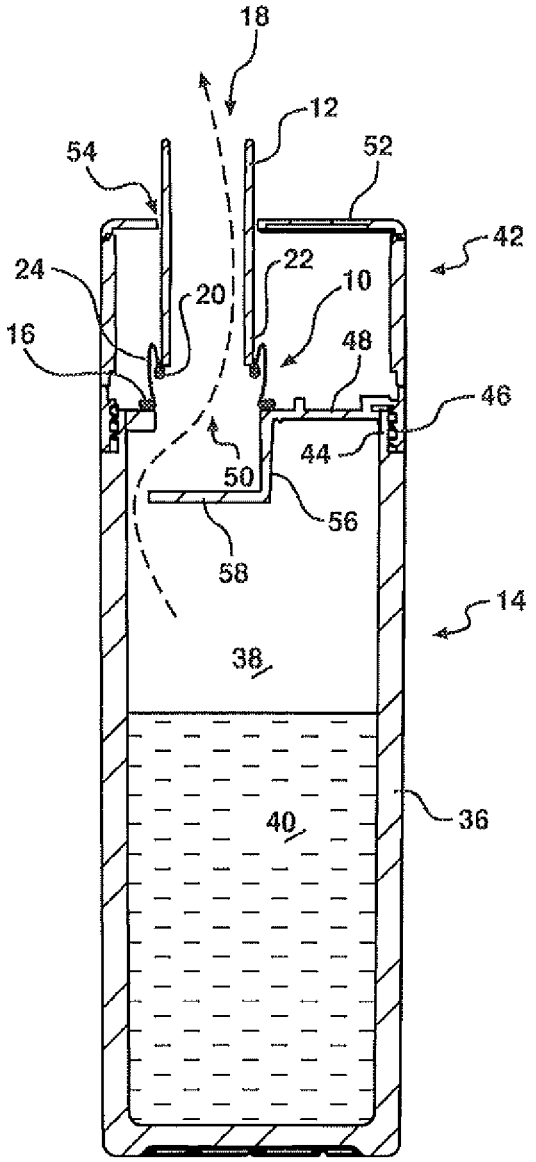
FIG. 3*b* is a schematic view of the seal and bottle of FIG. 3*a*, illustrating the spout in an extended position.

FIGS. 3*a* and 3*b*, illustrate the attachment of the seal 10 to one embodiment of the container 14 having a movable spout 12. The container 14 includes a base 36 defining a chamber 38 for holding a flowable material 40, in the present embodiment being a liquid. A lid assembly 42 is attached to the base 36 by way of cooperating screw threads 44, 46. The lid assembly 42 includes an internal frame 48 having aperture 50 and a top cover 52 also including an aperture 54. The apertures 50 and 54 coaxially align to thereby define the opening 18 in the container 14.

The internal frame 48 further include a depending leg or legs 56 that are configured to hold the platform 56 spaced apart from the opening 18.

As illustrated in FIG. 3*a*, the first annular end 16 is attached to or fixedly held by the internal frame 48. The second annular end 20 is configured to engage with and extend downwardly from the inner end 22 of said spout 12.

As further illustrated in FIG. 3*a*, the spout 12 is able to, at least partly, retract through aperture 50 when in the retracted position, whereby the second annular end 20 bears against the platform 58 to thereby inhibit movement of the liquid out through the spout 12.

When the spout 12 is moved into the extended position, as illustrated in FIG. 3*b*, the first and second annular ends 16, 20 remain fixed to frame 48 or spout 12 respectively. The spout 12 extends at least partly out through aperture 54 in the top cover 52 when in the extended position and the fluid 38 is able to move out through the opening 18, as indicted by the broken arrow in FIG. 3*b*, when the container 14 is tilted. When the spout 12 is moved back into the fully retracted position the flow of fluid 38 is inhibited or stopped because the second annual end 20 bears against the bearing surface of the platform 58.

Figure 4:
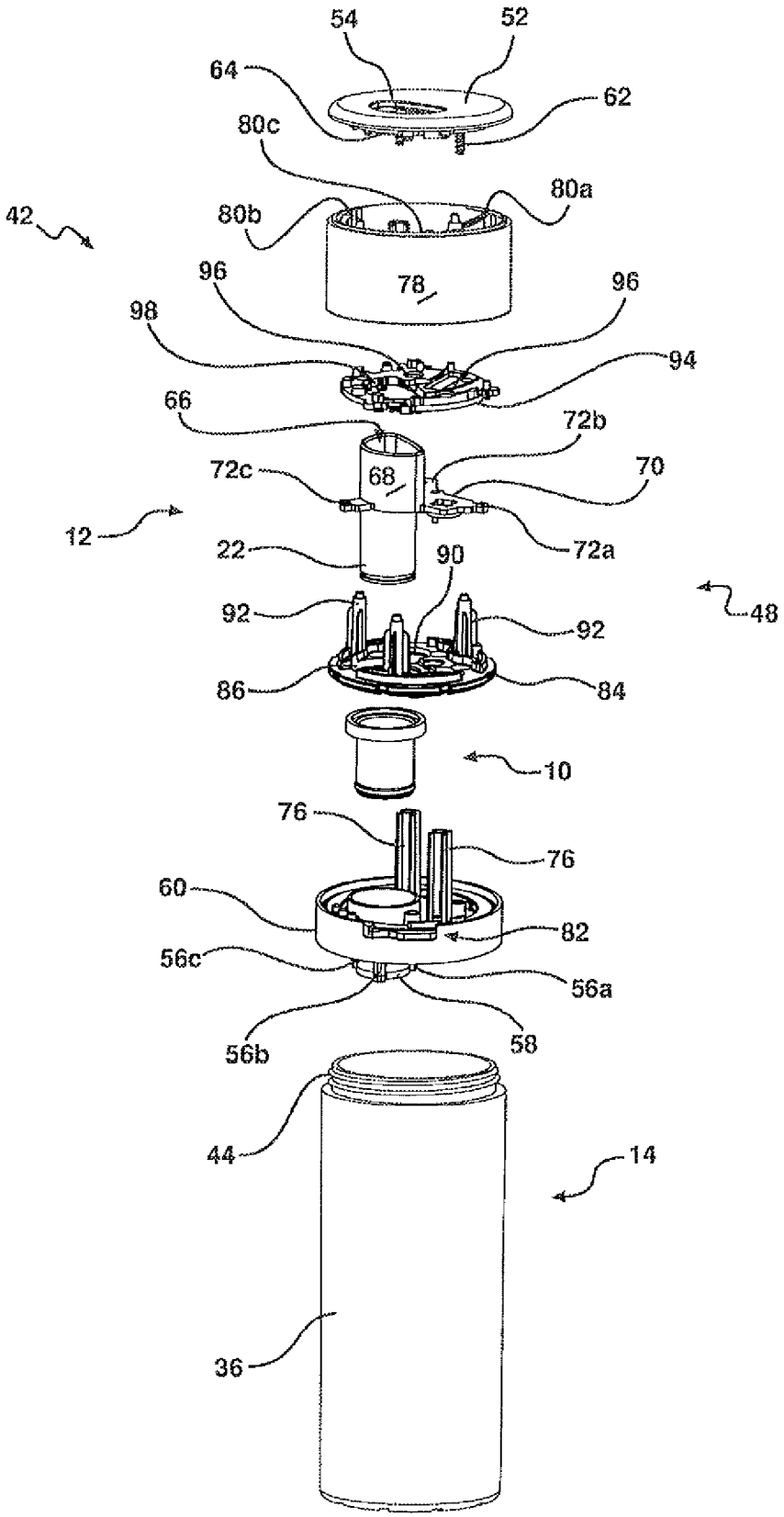
FIG. 4 is an exploded view of one possible embodiment of the bottle and movable spout.

FIG. 4 illustrates an exploded view of one possible embodiment of the lid assembly 42. Similar configurations of movable spouts have been previously disclosed by the present Applicant in International Applications, PCT/AU2015/050567 entitled Bottle Lid Assembly with Retractable Spout, and PCT/AU2018/050293 entitled Apparatus and Method for Measuring Fluid Consumption, which are incorporated herein by reference. Some of the details of the movable spout and operation thereof, will not be repeated to not obscure the present invention.

The top cover 52 of the present embodiment, can be fixed relative to a lid base member 60 by way of fixing members 62. The top cover 52 includes the aperture 54 that can be closed by a pivotable flap 64.

The spout 12 includes a fluid pathway 66, mouthpiece 68, inner end 22 and projection 70 having fingers 72*a*, 72*b*, 72*c* that extend sidewardly from an opposite side of the spout 12. The projection 70 includes apertures 74 that are configured to engage respective spring posts 76.

The lid assembly 42 further includes a generally cylindrical main body 78, that is able to rotated relative to the lid base member 60 and includes inwardly projecting flanges 80*a*, 80*b*, 80*c* in the form of a flight or three start threads. The fingers 72*a*, 72*b*, 72*c* abut an underside of the inwardly projecting flanges 80*a*, 80*b*, 80*c* and act as a guide when the spout 16 is moving between retracted and extended positions, as disclosed in PCT/AU2015/050567, which is incorporated herein by reference.

As illustrated in FIG. 4, the lid base member 60 includes three depending legs 56*a*, 56*b* and 56*c* that support or hold the platform 58 spaced apart from the opening 18. The lid assembly 42 further includes a latch mechanism 82 that inhibits rotation of the main body 78 against the influence of biasing springs (not shown) that engage respective spring posts 76.

The lid assembly 42 also includes an insert 84 having apertures 86, 90 shaped to slid over spring posts 76 and permit passage of the spout 12 therethrough. The insert 84 is attached to the lid base member 60 by way of screws (not shown) that engage though respective apertures. Three legs 92 extend upwardly and are configured to engage a plate 94 that is attached over spring posts 76 that passes though apertures 96. The plate 94 similarly includes an aperture 98 that permits passage of the spout 12 therethrough.

Figure 5A:
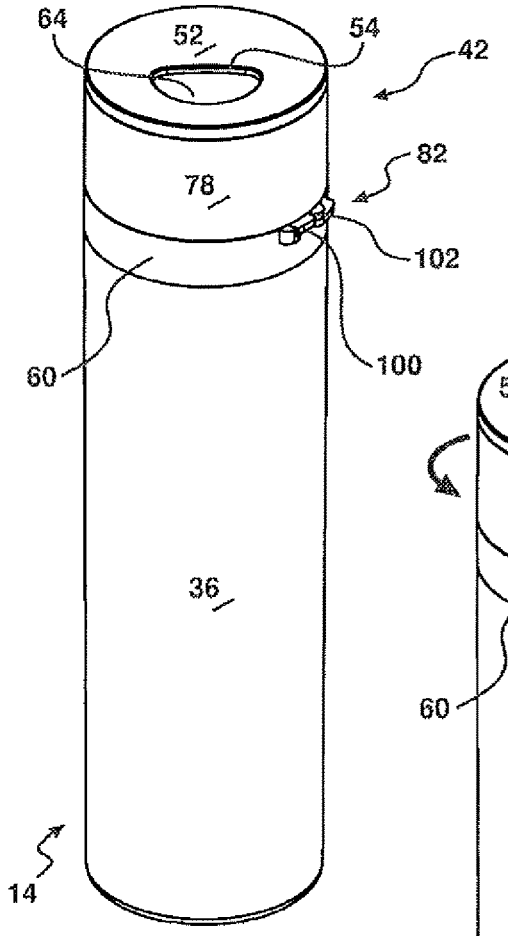
FIG. 5*a* is a perspective view of the bottle of FIG. 4, illustrating a pivotable flap covering the bottle opening thereby concealing the spout.
Figure 5B:
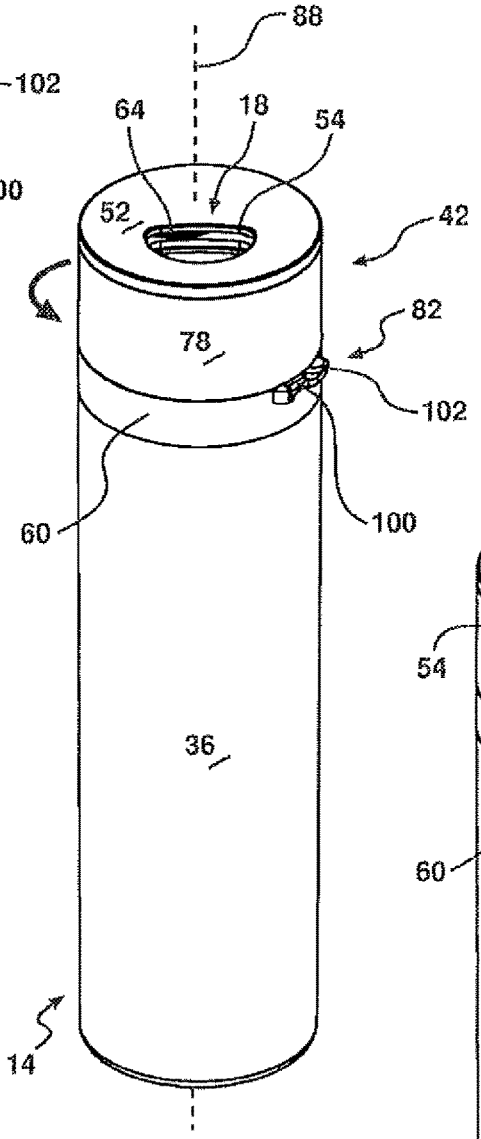
FIG. 5*b* is a perspective view of the bottle of FIG. 5*a* illustrating the movement of the main body of the lid assembly and the pivotable flap.
Figure 5C:
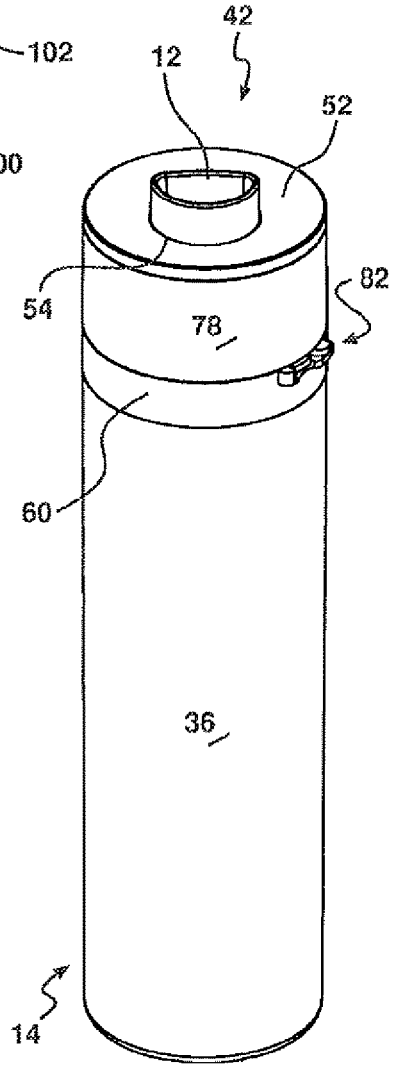
FIG. 5*c* is a perspective view of the bottle of FIG. 5*b* illustrating the spout in an extended position.

FIGS. 5*a* to 5*c* illustrate the operation of the lid assembly 42 of the present embodiment. FIG. 5*a* illustrates the spout 12 in a retracted position within the lid assembly 42, wherein the pivotable flap 64 covers or closes aperture 54. The releasable latch mechanism 82 comprises a button 100 and locking device 102, wherein rotation of the main body 78 is inhibited.

To extend the spout 12 a user releases the locking device 102 and depresses the button 100 to trigger the spout 16 to move under the influence of the biasing springs from the retracted position, as shown in FIG. 5*a*, into the extended position, as shown in FIG. 5*c*. This is accomplished by rotation of the main body 78 around the longitudinal axis 88, as indicated by the arrow in FIG. 5*b*.

As further illustrates in FIG. 5*b*, the pivotable flap 64 clears the aperture 54 to enable the spout 12 to move upwardly therethrough, from the retracted position to the extended position. In the extended position, as shown in FIG. 5*c*, the user can utilise the spout 16 to access the fluid 40 contained within the bottle 14.

When the user has finished drinking or pouring fluid from the spout 12, they can grasp the outer surface of the main body 78 and manually rotate it against the bias of the biasing springs into the closed position, wherein the spout 12 is retracted and the pivotable flap 64 closes opening 54. The latch mechanism 82 then maintains the spout 12 in the retracted position against the bias until the button 100 is actuated by a user.

Figure 6:
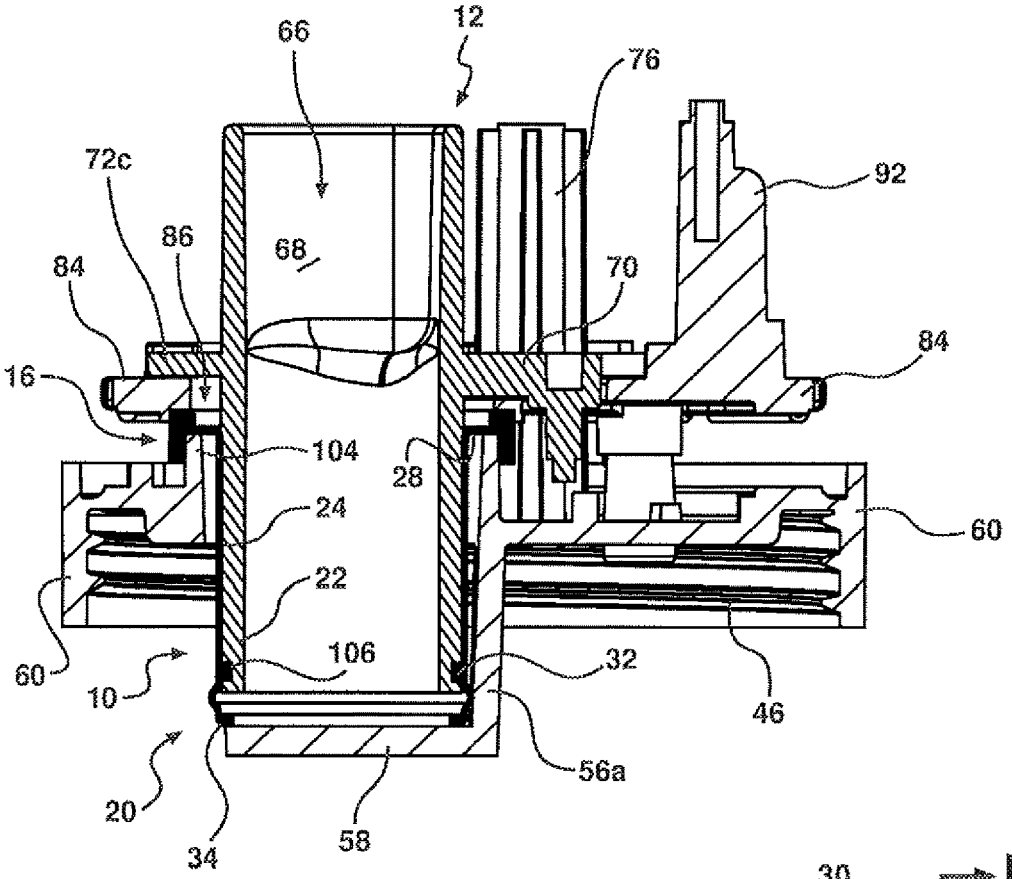
FIG. 6 is a partial cross-sectional view of the lid assembly of FIG. 5*a*, illustrating the position of the seal relative to the spout when the spout is in a retracted position.
Figure 9:
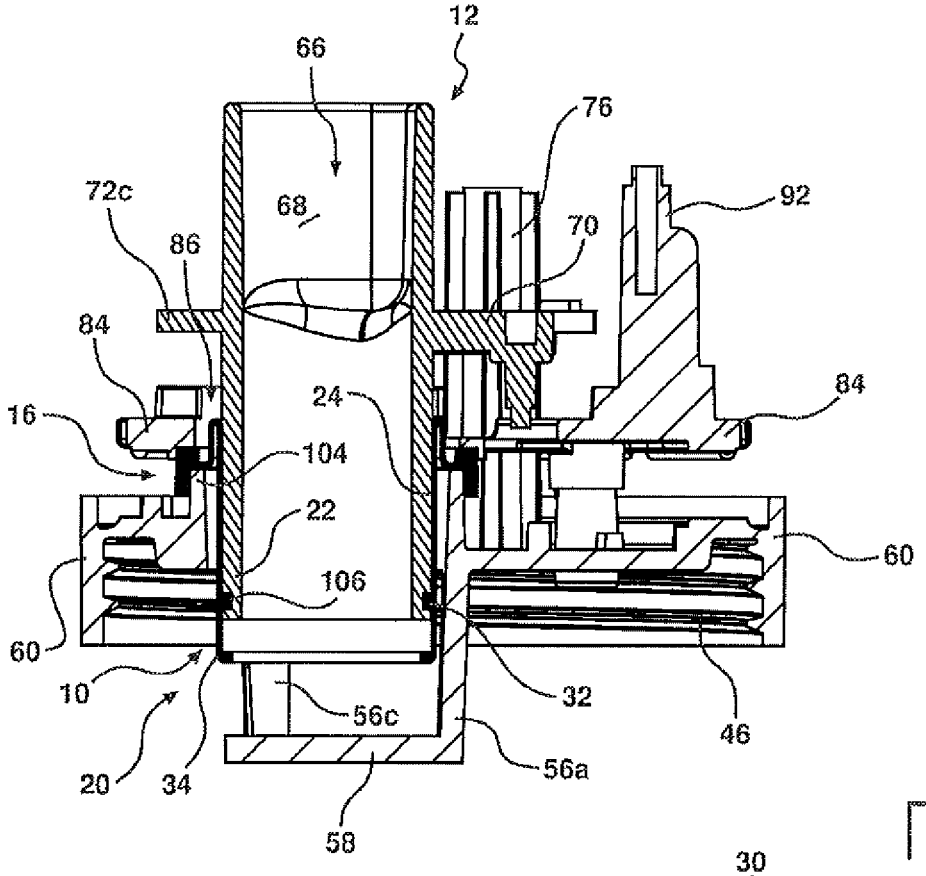
FIG. 9 is a partial cross-sectional view of the lid assembly of FIG. 5*b*, illustrating the position of the seal relative to the spout, when the spout is in a partially extended position.
Figure 12:
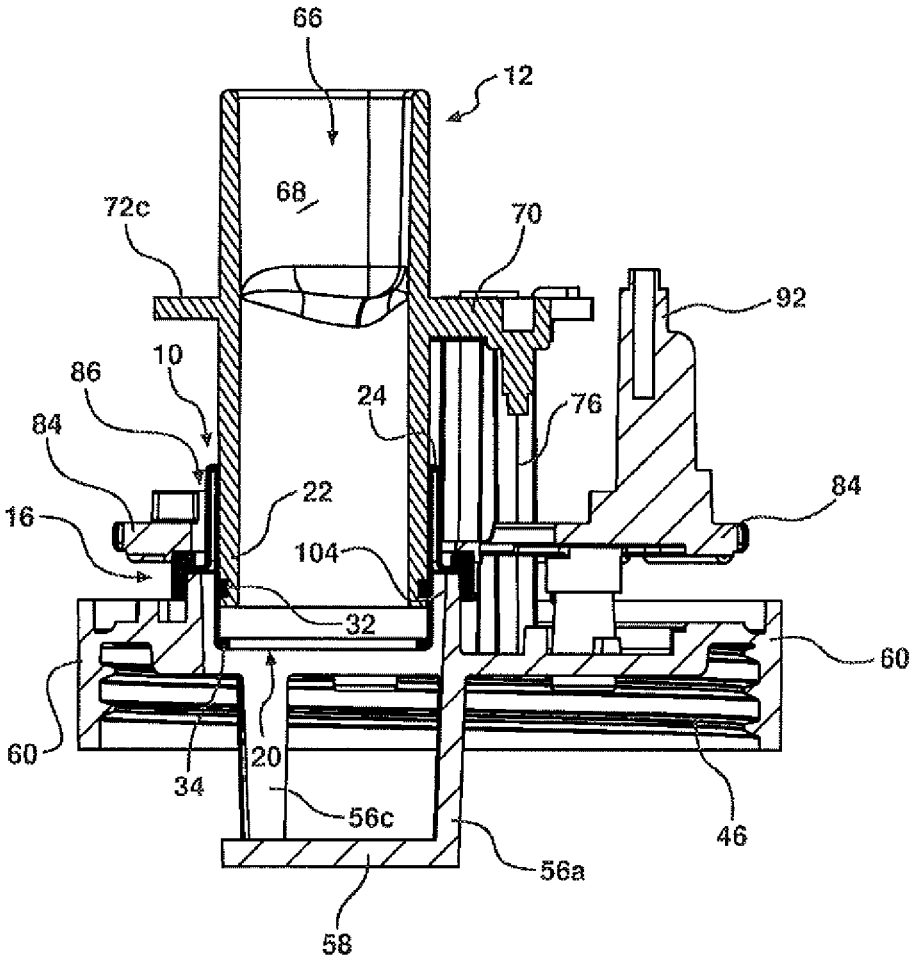
FIG. 12 is a partial cross-sectional view of the lid assembly of FIG. 5*c*, illustrating the position of the seal relative to the spout, when the spout is in a fully extended position.

As illustrated is FIG. 6, the base member 60 includes an upstand 104 that has an annular shape and is configured to engage with the downwardly open groove 28 of the seal 10. As further illustrated in FIG. 6, the insert 84 abuts an upper surface of the shoulder 26 outwardly of the lip 30. In this way, the two separate members, the base member 60 and the insert 84, are configured to cooperate to thereby hold or clamp the first end 16 of the seal 10 therebetween as the spout 12 moves up and down through the opening 18. The inner or lower end 22 of the spout 12 includes a slit 106 extending circumferentially around the spout 22 that is configured to engage with thickened portion 32 of the seal 10, as shown in FIGS. 6, 9 and 12. The slit 106 is configured to assist in maintaining the position of the second annual end 20 on the inner end 22 of the spout 12. The reader should however appreciate that the inner end 22 may simply frictionally engage the second annual end 20.

Figure 7:
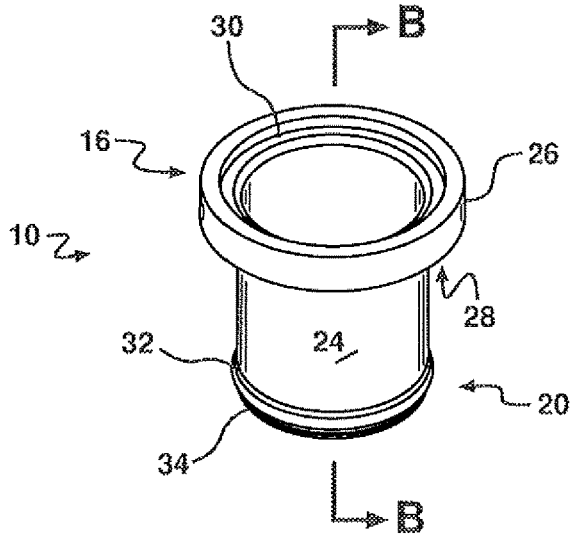
FIG. 7 is a perspective view of the seal of FIG. 6 in an elongate arrangement.
Figure 8:
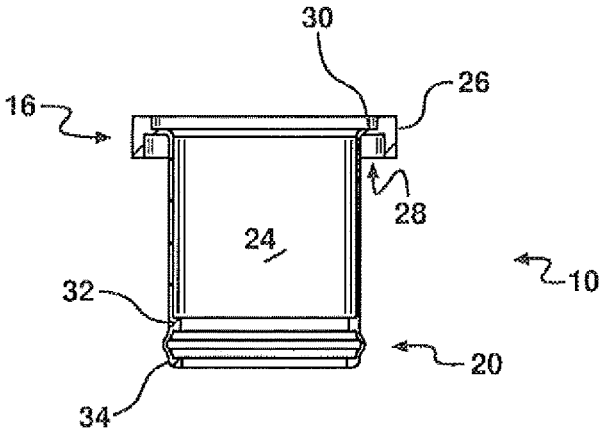
FIG. 8 is a cross-sectional view of the seal through B-B of FIG. 7.

FIGS. 6 to 8, illustrate the arrangement of the seal 10 when the spout 12 is in a retracted positioned. In this arrangement, the intermediate portion 24 is stretch downwardly over the outer surface of the spout 12 and the second end 20 is compressed against the platform 58. It should be appreciated by the reader that the intermediate portion 24 preferably conforms to the outer surface of the spout 12.

When the button 100 is pushed to release the latch mechanism 82, the spout moves up the spring posts 92 as it begins to move into the extended position.

Figure 10:
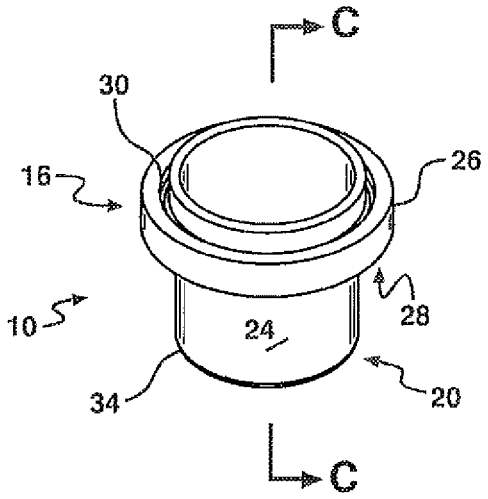
FIG. 10 is a perspective view of the seal of FIG. 9 in a partially inverted arrangement.
Figure 11:
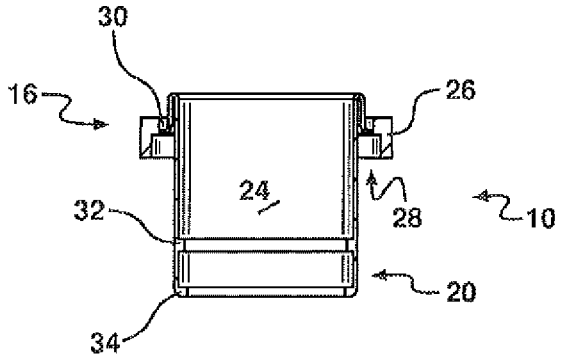
FIG. 11 is a cross-sectional view of the seal through C-C of FIG. 10.

FIGS. 9 to 11 illustrate the arrangement of the seal 10 and spout 12 in a midway position between the fully retracted and fully extended positions. As the spout 12 moves upwardly the intermediate portion 24 begins to invert or fold over itself as it moves inwardly through the first annular end 16. The reader should appreciate that the inner annular lip 30 provides greater flexibility for the intermediate portion 24 as it moves inwardly through the first annular end 16. The second annular end 20 is also now in an uncompressed arrangement, as can best be seen by comparing FIGS. 6 and 9 or FIGS. 8 and 11.

Figure 13:
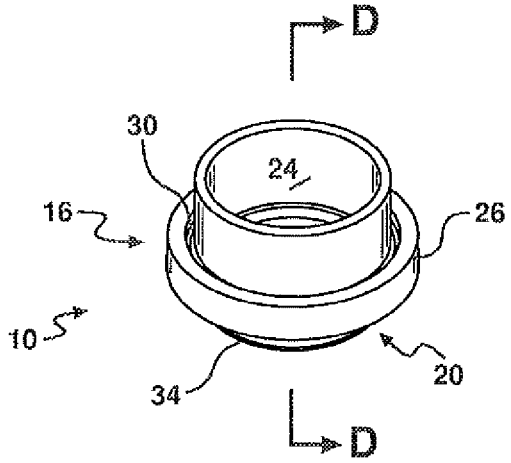
FIG. 13 is a perspective view of the seal of FIG. 12 in an inverted arrangement.
Figure 14:
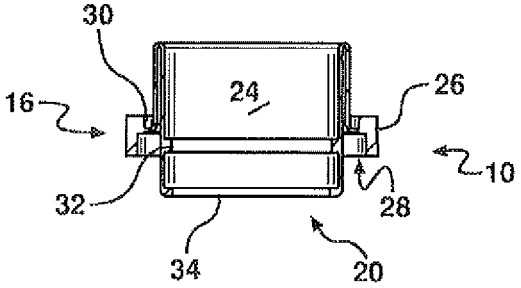
FIG. 14 is a cross-sectional view of the seal through D-D of FIG. 13.

FIGS. 12 to 14 illustrate the arrangement of the seal 10 and spout 12 in a fully extended position. In the present embodiment, the second annular end 20 remains inwardly of the first annular end 16 with the intermediate portion 24 completely folded over itself and extending upwardly through the aperture 86 of the insert 84.

Figure 17:
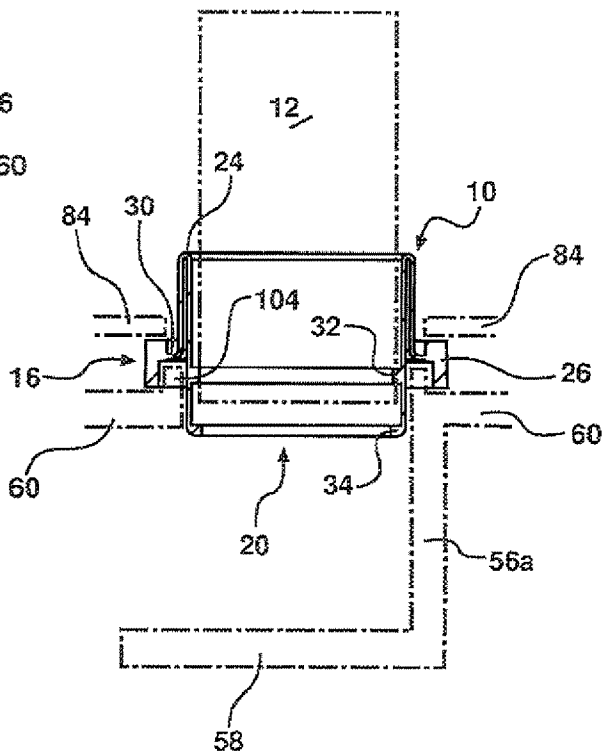
FIG. 17 is a schematic view of FIG. 12, illustrating movement of the intermediate portion of the seal as it continues to fold over itself.
Figure 16:
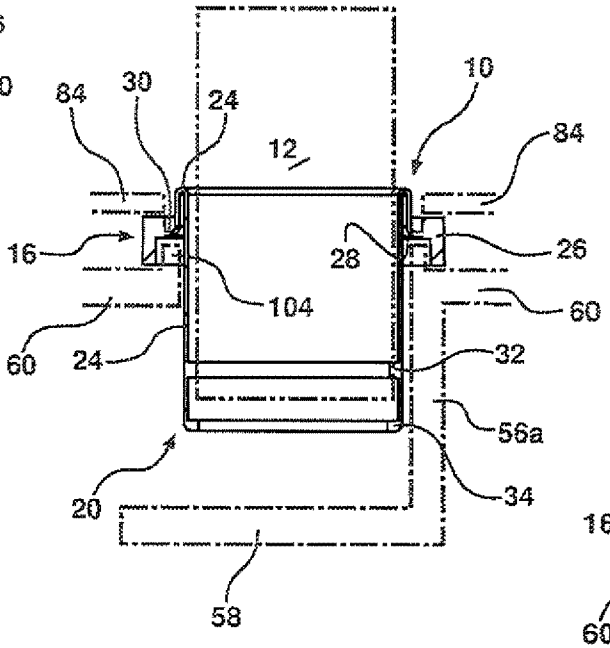
FIG. 16 is a schematic view of FIG. 9, illustrating movement of the intermediate portion of the seal as it begins to fold over itself.
Figure 15:
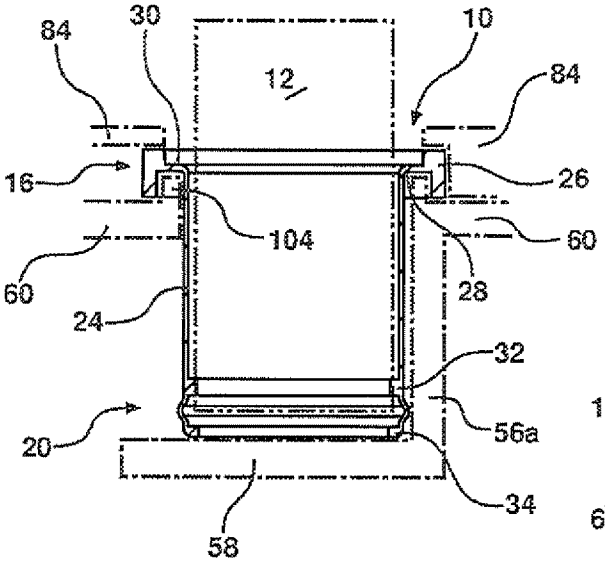
FIG. 15 is a schematic view of FIG. 6, illustrating the seal bearing against the platform.

FIGS. 15 to 17 illustrate a simplified configuration of the lid assembly 42 and the progressive movement of the spout 12 from a retracted position, as illustrated in FIG. 15, through an intermediate position, as illustrated in FIG. 16, into an extended position, as illustrated in FIG. 17. The reader will appreciate that FIGS. 15 to 17 illustrate the movement of seal 10 at is inverts or folds over itself.

Figure 18:
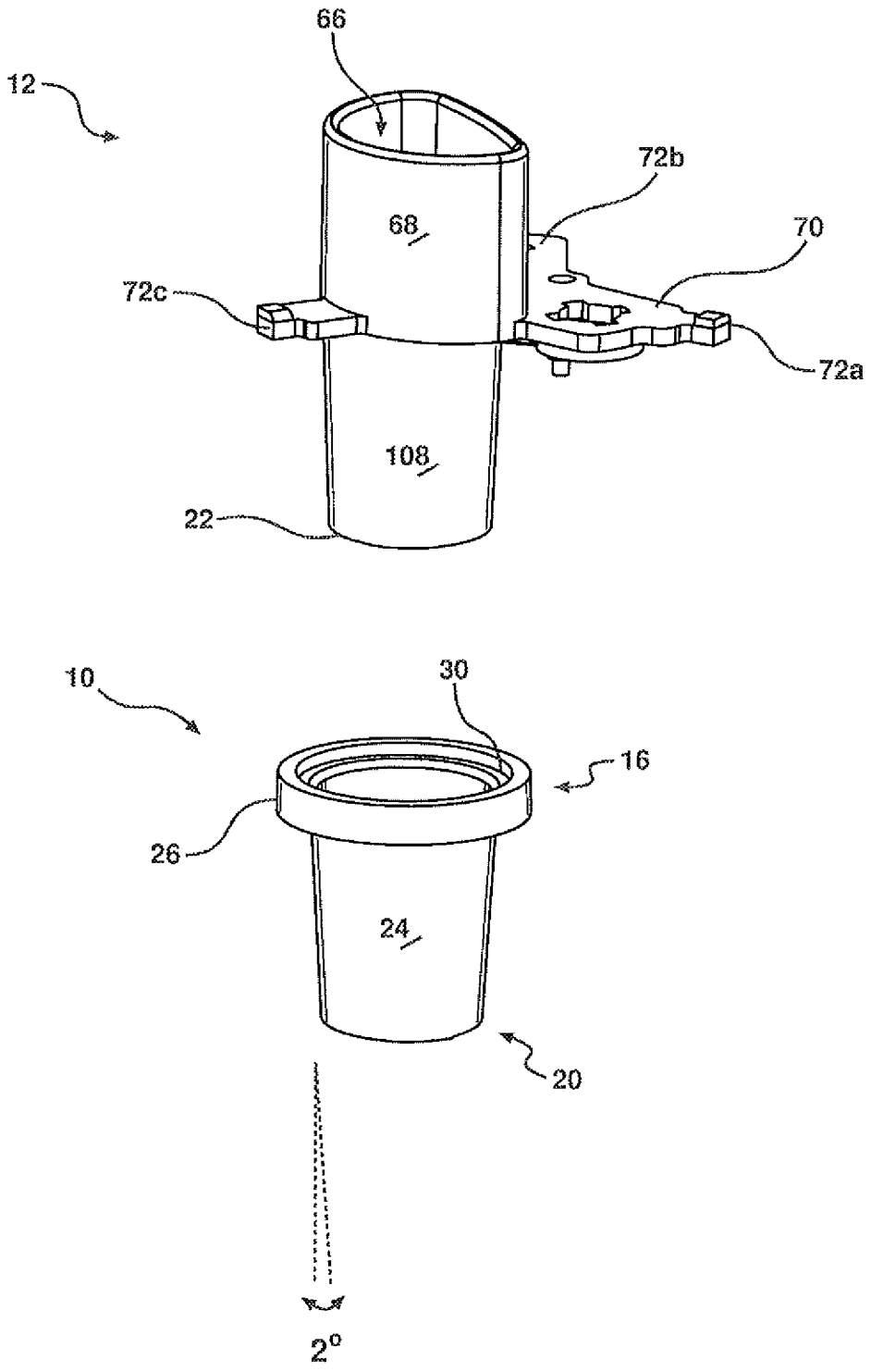
FIG. 18 is a perspective view of another embodiment of the seal which is tapered to engage with a tapered spout.

FIG. 18 illustrates a second embodiment of the seal 10 that has a tapered intermediate portion 24, such that it is configured to engage with a tapered portion 108 of the spout 12. The taper on the seal 10 of the present embodiment, is 2 degrees and the tapered portion 108 of the spout 12 is correspondingly shaped to assist with maintaining fractional engagement. The second annular end 20 of the seal 10 in the present embodiment is of uniform thickness and does not include thickened portions. Therefore, the inner end 22 of the spout 12, shown in FIG. 18, does not include a slit 106 extending circumferentially around the spout 22, however the reader should appreciate that the end 22 may alternatively include an annular slit, as previously discussed, for retaining a part of the seal 10.

Figure 19:
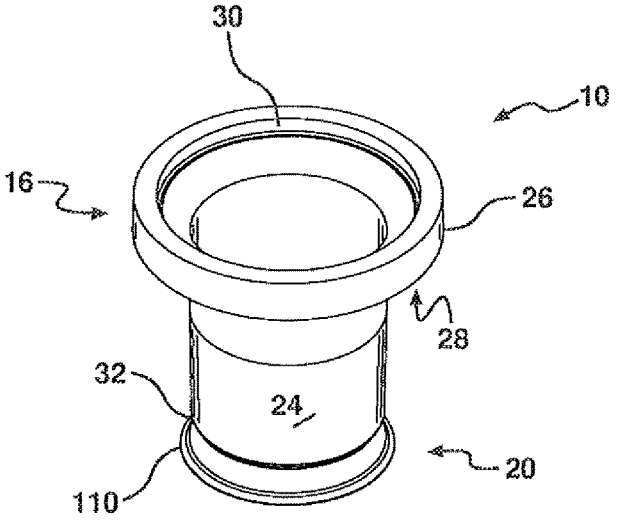
FIG. 19 is a perspective view of a further embodiment of the seal.
Figure 21:
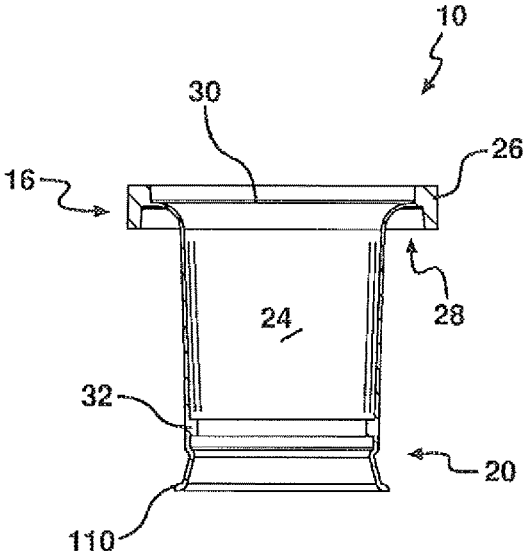
FIG. 21 is a cross-sectional view of the seal through E-E of FIG. 20.
Figure 20:
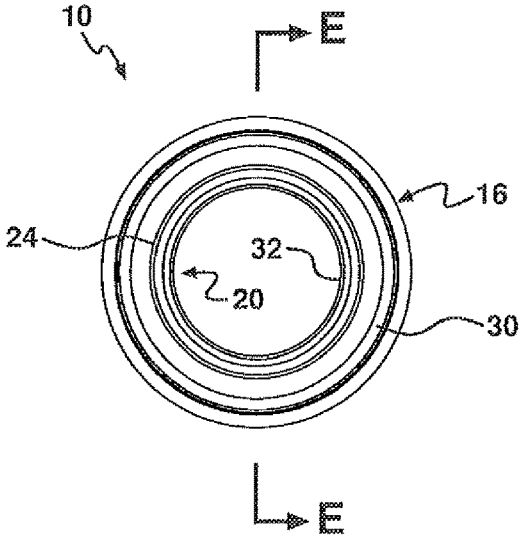
FIG. 20 is a top view of the seal of FIG. 19.

FIGS. 19 to 21 show another embodiment of the seal 10 that includes a lower or second annular end 20 having a thickened portion 32 and a depending annular skirt 110, which bears against the platform 58 when the spout 12 is in the retracted position. As illustrated in FIG. 21, the skirt 110 is splayed towards a lower edge to assist in sealing against the platform 58.

Figure 22:
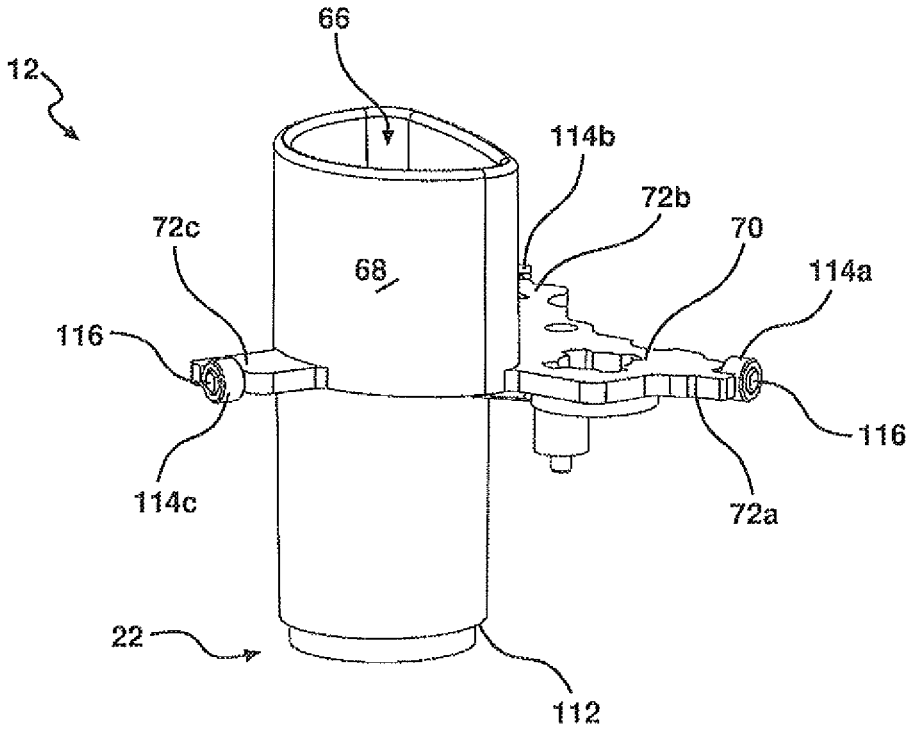
FIG. 22 is a perspective view of another embodiment of the spout.

The thickened portion 32 is configured to engage overhang 112, illustrated in FIG. 22, that is located at the lower end 22 of said spout 12. FIG. 22 further illustrates rollers 114*a*, 114*b*, 114*c*, that engage respective spigots 116 on fingers 72*a*, 72*b*, 72*c*. The rollers 114*a*, 114*b*, 114*c* engage an underside of the inwardly projecting flanges 80*a*, 80*b*, 80*c* to reduce friction and thereby assist in the movement of the spout 12 between retracted and extended positions, as described in PCT/AU2015/050567, which is incorporated herein by reference.

The reader will also appreciate that the present embodiment discloses a sealable container and method of use. Various fixing means and other components may be used to construct the lid assembly 14, which are not currently illustrated but which would be obvious to a person skilled in the art. Details of some of the fixing means other components or equivalent parts, and the operation of the moveable spout in general are detailed in International Applications PCT/AU2015/050567 and PCT/AU2018/050293, both in the name of the present Application, which are incorporated herein by reference.

The skilled addressee will now appreciate the advantages of the illustrated embodiments over the prior art. In one form there is provided a seal for a drinking vessel and in another form a sealable container including a seal. The seal inhibits movement of the liquid or other flowable material out between the outer surface of the spout and the sides of the opening through which the spout is configured to extend. Furthermore, the seal inhibits movement of the flowable material out through the spout when in a retracted position. In this way, the invention provides a dual function seal for a movable spout.

Various features of the invention have been particularly shown and described in connection with the exemplified embodiments of the invention, however it must be understood that these particular arrangements merely illustrate the invention and it is not limited thereto. Accordingly, the invention can include various modifications, which fall within the spirit and scope of the invention.

The invention claimed is:

1. A seal for a retractable spout of a container, comprising:

a flexible generally elongate tubular body;

a first annular end fixedly held circumferentially around or adjacent, an opening in said container through which said retractable spout is configured to move, to thereby inhibit movement of a flowable substance out between an outer surface of said tubular body and an edge of said opening;

an opposite second annular end fixedly couplable to and extending downwardly from a lower end of said retractable spout, whereby when the retractable spout is in a retracted position the second annular end of the seal bears against an abutment surface of the container to thereby inhibit movement of said flowable substance out through said retractable spout; and wherein an intermediate portion of the tubular body moves inwardly of the first annular end such that the intermediate portion is inverted or folded over itself as the retractable spout is moved from said retracted position into an extended position, such that the intermediate portion of the tubular body rolls or folds over itself.

2. The seal in accordance with claim 1, wherein the abutment surface comprises a platform or an insert supported thereon, and wherein the abutment surface is spaced apart from said opening.

3. The seal in accordance with claim 1, wherein the container includes a lid assembly having a cover with a first aperture extending therethrough and an internal frame having a second aperture extending therethrough, wherein the first and second apertures coaxially align to thereby delineate said opening in the container.

4. The seal in accordance with claim 3, wherein the first annular end is fixedly held by the internal frame, wherein the retractable spout is able to at least partly retract through the second aperture when in said retracted position, and extend at least partly through the first aperture when in said extended position.

5. The seal in accordance with claim 4, wherein the second aperture of the internal frame is dimensioned to allow passage of at least a part of the intermediate portion of the seal therethrough and is dimensioned to allow passage of the second annular end, when the retractable spout is being moved between the retracted and extended positions.

6. The seal in accordance with claim 5, wherein the internal frame includes a plurality of depending legs, which hold the platform in a spaced apart position inwardly of said opening.

7. The seal in accordance with claim 3, wherein the first end of the seal includes an outwardly projecting circumferential shoulder, wherein a downwardly open groove extends into or is formed by the shoulder, such that the groove extends generally circumferentially around the first end.

8. The seal in accordance with claim 7, wherein the upper surface of the shoulder includes an inner annular lip that extends therearound, the shoulder being configured to engage with said internal frame to thereby fixedly hold the first end thereto.

9. The seal in accordance with claim 7, wherein the internal frame is formed by two separate members that are configured to cooperate to thereby hold or clamp the first end or shoulder of the seal therebetween.

10. The seal in accordance with claim 1, wherein the second annular end includes a plurality of spaced apart thickened portions, which assist in the engagement with the lower end of the retractable spout, such that the second annular end is inhibited from detaching therefrom.

11. The seal in accordance with claim 2, wherein the second annular end includes an annular splayed skirt which assists in engagement with the platform, when the retractable spout is in the retracted position.

12. The seal in accordance with claim 1, wherein the intermediate portion of the seal is tapered between 1 and 5 degrees, or 2 degrees, whereby the tapered intermediate portion is configured to engage with a correspondingly shaped tapered portion of the retractable spout to thereby assist with maintaining fractional engagement.

13. A sealable container, including:

a body having a chamber for holding a flowable substance;

a lid connectable to said body, the lid including an opening extending therethrough;

a spout movable through said opening between a retracted position and an extended position;

a platform inward of and spaced apart from said opening;

a flexible generally elongate tubular body having a first annular end being fixedly held circumferentially around or adjacent, an opening in the sealable container through which said spout is configured to extend, to thereby inhibit movement of a flowable substance out between an outer surface of said tubular body and an edge of said opening, and an opposite second annular end coupled to and extending downwardly from a lower end of said spout, whereby when the spout is in a retracted position the second annular end of the seal bears against an abutment surface of the sealable container to thereby inhibit movement of said flowable substance out through said spout, wherein the abutment surface comprises said platform or an insert supported thereon, and wherein an intermediate portion of the tubular body moves inwardly of the first annular end such that the intermediate portion is inverted or folded over itself as the spout is moved from said retracted position into an extended position.

14. A method of sealing a container with a movable spout, including the steps of:

providing a container, including a body having a chamber for holding a flowable substance, a lid connectable to said body, the lid including an opening extending therethrough, a spout movable through said opening between a retracted position and an extended position, and a platform inward of, and spaced apart from, said opening;

providing a flexible generally tubular seal having a first annular end, an intermediate portion and a second annular end;

inserting the spout into the generally tubular seal, wherein the first annular end and intermediate portion circumferentially extend around the spout and the second annular end is coupled to and extends downwardly from a lower end of the spout;

fixing the first annular end circumferentially around, or adjacent, said opening to thereby inhibit movement of the flowable substance out between an outer surface of the spout and a circumferential edge of said opening; and causing the spout, to be moved from:

a. a retracted position, wherein the second annular end bears against the platform or an insert supported thereon to thereby inhibit movement of the flowable substance through the spout;

b. through transitional positions, wherein said intermediate portion of the tubular seal is inverted or folded over itself; and c. into an extended position, whereby the second annular end is separated from the platform or the insert supported thereon, wherein said flowable substance is able to flow out through the spout.

* * * * *